US005197893A

United States Patent [19]

Morlion et al.

[11] Patent Number: 5,197,893

[45] Date of Patent: Mar. 30, 1993

[54] CONNECTOR ASSEMBLY FOR PRINTED CIRCUIT BOARDS

[75] Inventors: Danny L. C. Morlion, Ghent; Luc Jonckheere, Louvain; Geert A. Lips, Oostduinkerke, all of Belgium

[73] Assignee: Burndy Corporation, Norwalk, Conn.

[21] Appl. No.: 844,992

[22] Filed: Mar. 2, 1992

Related U.S. Application Data

[63] Continuation of Ser. No. 666,835, Mar. 8, 1991, abandoned.

[30] Foreign Application Priority Data

Mar. 14, 1990 [NL] Netherlands ..... 9000578

[51] Int. Cl.[5] ..... H01R 13/652; H01R 13/658

[52] U.S. Cl. ..... 439/101; 439/108; 439/608

[58] Field of Search ..... 439/101, 108, 607, 608, 439/609, 610

[56] References Cited

U.S. PATENT DOCUMENTS

| | | | |
|---|---|---|---|
| 4,611,867 | 9/1986 | Ichimura et al. | 439/608 |
| 4,846,727 | 7/1989 | Glover et al. | 439/608 |
| 4,867,707 | 9/1989 | Widdoes | 439/675 |
| 4,881,905 | 11/1989 | Demler et al. | 439/79 |
| 4,975,084 | 12/1990 | Fedder et al. | 439/608 |

FOREIGN PATENT DOCUMENTS

| | | |
|---|---|---|
| 3511344 | 10/1986 | Fed. Rep. of Germany . |
| 83/01540 | 4/1983 | PCT Int'l Appl. . |
| 88/02560 | 4/1988 | PCT Int'l Appl. . |

*Primary Examiner*—Gary F. Paumen
*Attorney, Agent, or Firm*—Perman & Green

[57] ABSTRACT

A connector assembly for printed circuit boards, comprises a first connector element with a first housing of insulating material and regularly arranged male signal and ground contacts connectable to a printed circuit board, and a second connector element with a second housing of insulating material, which can be inserted with an insertion side into the first housing, and with regularly arranged female signal and ground contacts with a connection element. These female contacts will contact the corresponding male contacts when the second housing is received in the first housing. The second connector element is provided with a plurality of outer conductors, each of said outer conductors mainly enclosing at least one signal contact in a circumferential direction and each of said outer conductors being adapted to contact the adjacent ground contacts of the/each corresponding signal contact of the first connector element.

20 Claims, 12 Drawing Sheets

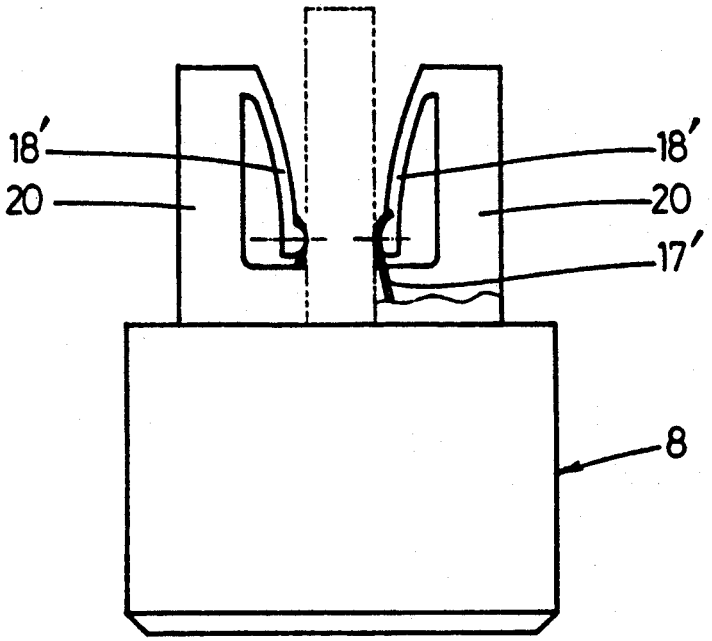
FIG.2
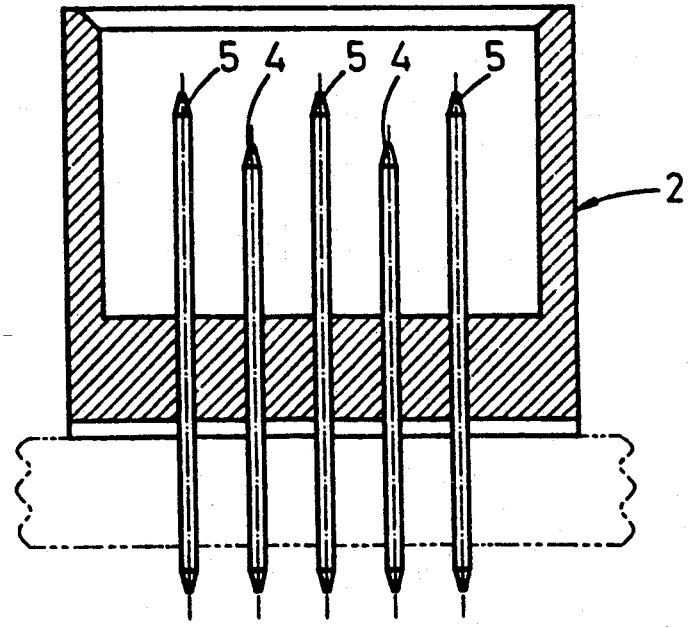

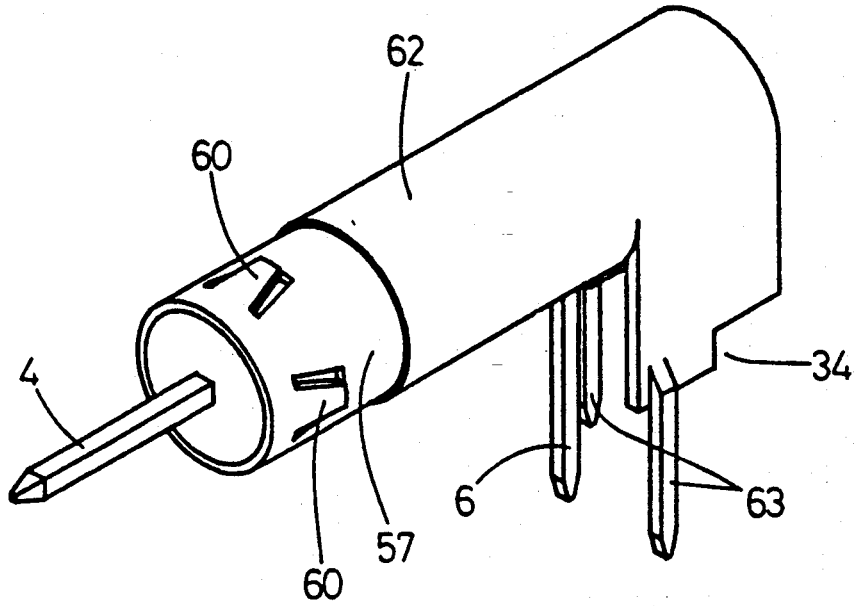
FIG.18
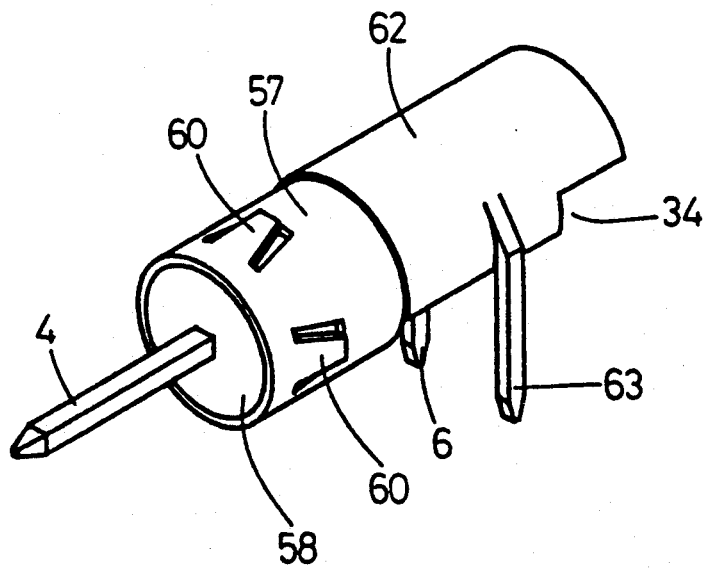

CONNECTOR ASSEMBLY FOR PRINTED CIRCUIT BOARDS

This is a continuation of copending application Ser. No. 07/666,835 filed on Mar. 8, 1991, now abandoned.

FIELD OF THE INVENTION

The invention relates to a connector assembly for printed circuit boards, comprising a first connector element with a first housing of insulating material and regularly arranged male signal and ground contacts connectable to a printed circuit board, and a second connector element with a second housing of insulating material, which can be inserted with an insertion side into the first housing, and with regularly arranged female signal and ground contacts with a connection element, which female contacts will contact the corresponding male contacts when the second housing is received in the first housing.

BACKGROUND OF THE INVENTION

Such connector assemblies are known in various embodiments. In the design of the known connector assemblies attention has mainly been paid to the mechanical aspects of the connector assembly, in particular with respect to the forces required for coupling and decoupling the connector elements. Attention was only paid to the electrical aspects in that one aimed at realizing good reliable connections between the contacts of both connector elements. With increasing speeds of the digital signals to be transferred, i.e. decreasing rise times, the electrical performance of the contacts as a circuit element becomes important. In the known connector assemblies problems occur with higher signal speeds with respect to cross-over between signal contacts, transmission losses, reflections and ground bounce or switching noise. Despite an optimal distribution of the ground and signal contacts these problems cannot be eliminated below rise times of 0.6 ns in the known connector assemblies.

SUMMARY OF THE INVENTION

The invention aims to provide a connector assembly of the above-mentioned type wherein the problems occurring at high signal speeds in the known connector assemblies can be obviated by making the connector elements in such a manner that the performance of the contacts as a circuit element can be previously determined and said signal distortions are minimized.

To this end the connector assembly according to the invention is characterized in that said second connector element is provided with a plurality o±outer conductors, each of said outer conductors mainly enclosing at least one signal contact in a circumferential direction and each of said outer conductors being adapted to contact the adjacent ground contacts of the/each corresponding signal contact of the first connector element.

In this manner it is obtained that with coupled connector elements the signal contacts together with the corresponding outer conductors each form more or less a transmission line with a geometry, the dimensional parameters of which can be determined in such a manner that the electrical requirements which are made on the connector assembly, are met. Further it is possible to previously make an equivalent electrical diagram of the connector which can be used in designing the overall system in order to take account of the electrical performance of the connector assembly from the beginning. This latter possibility is an important advantage as at high bit rates an interaction occurs between the connector and the surrounding connection elements of the system, whereby the operation of the overall system is affected. With the connector assembly according to the invention it is now possible to obtain an optimal operation despite this interaction.

Further the connector assembly according to the invention shows the advantage that the connector elements and the male and female contacts can be made in a usual manner so that all known design and manufacturing techniques of the usual connector assemblies can be used advantageously. The connection between the male and female contacts is comparable with the same of the known connector assemblies so that the favourable mechanical properties thereof, such as coupling-/decoupling forces and in particular the tolerances with respect to the mutual positions of the contacts are maintained when used in rack and panel configurations. Further all contacts and outer connectors can be manufactured from metal strips by stamping and forming so that the manufacturing costs of the connector assembly according to the invention are low.

Preferably each signal contact of the second connector element is mounted in the corresponding outer conductor by means of a dielectric insert. In this manner a reliable mounting of the signal contact in the corresponding outer conductor is realized. The impedance of each signal contact can be determined by using an insert wherein by providing more or less recesses the dielectric constant of the insert between the signal contact and the outer conductor can be determined. Thereby the combination of signal contact and outer conductor which can be considered as a transmission line, can be provided with a desired impedance.

BRIEF DESCRIPTION OF THE DRAWINGS

The invention will be further explained by reference to the drawings in which some embodiments are schematically shown.

FIG. 2 is a section corresponding with FIG. 1 of an amended embodiment of the connector assembly according to the invention.

FIG. 18 shows in perspective the outer conductors with signal contacts of the connector element of FIG. 17.

DETAILED DESCRIPTION OF THE INVENTION

Figure 1:
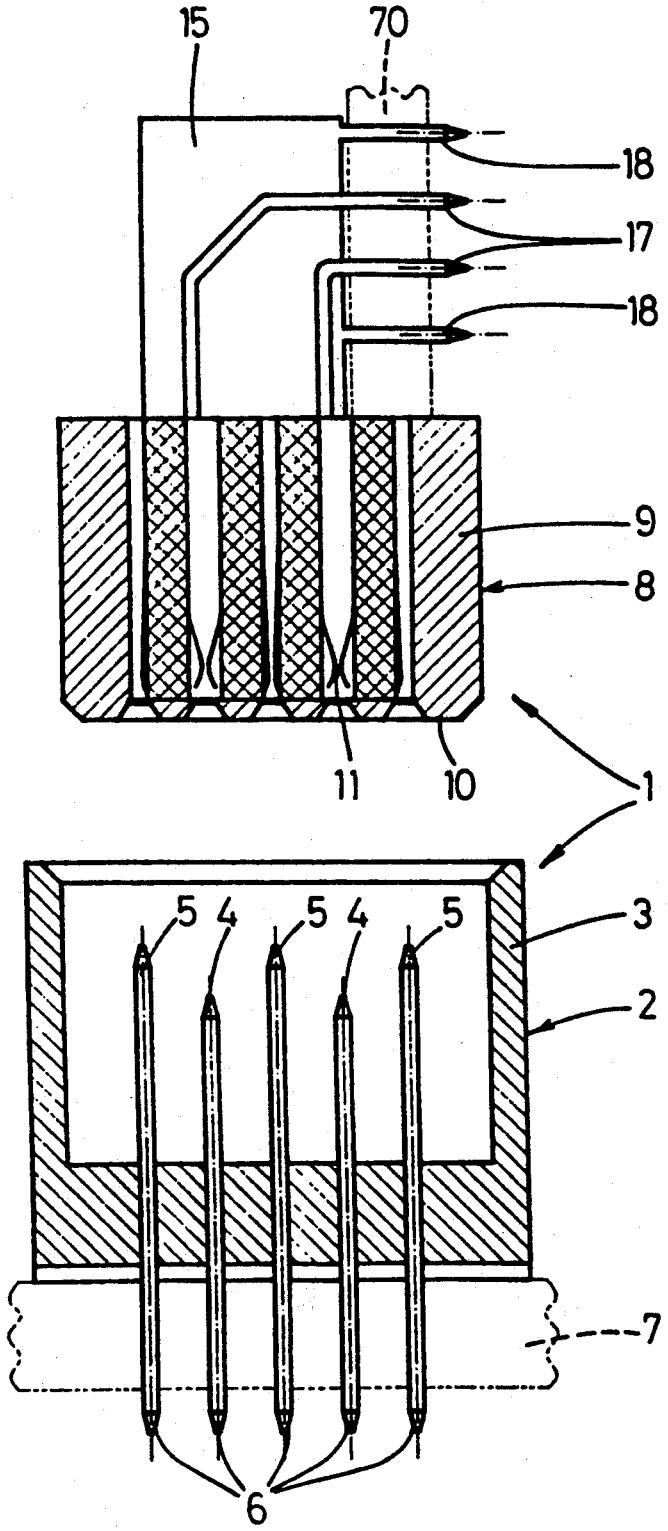
FIG. 1 is a section of a first embodiment of a connector assembly wherein the first and second connector elements are shown in a disassembled position.
Figure 3:
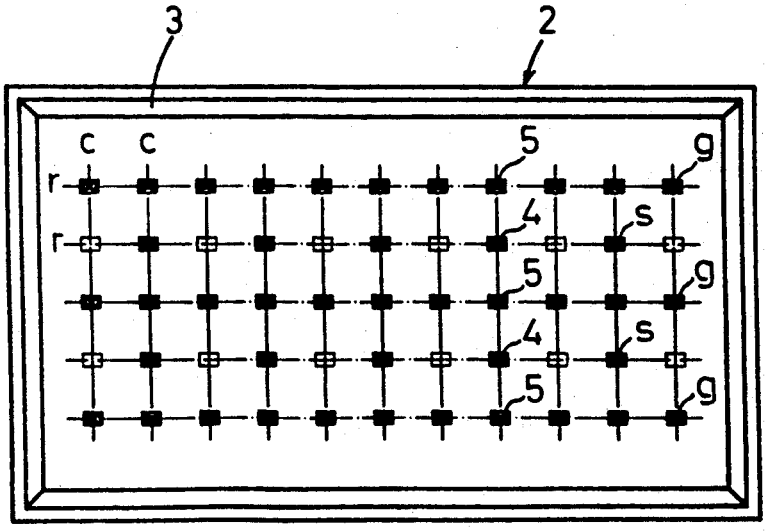
FIG. 3 is a top view of the first connector element of FIGS. 1 and 2.

Referring to FIG. 1 there is shown a cross-section of a connector assembly 1 comprising a first connector element 2 with a first housing 3 of insulating material and contact pins 4 and 5 arranged in parallel rows r and columns c (see FIG. 3). These contact pins 4, 5 each have a connection element 6, by which the contact pins 4, 5 can be connected with the plated inner wall of holes in a printed circuit board 7 indicated by a dashed. To this end the connection elements 6 are preferably provided with a known press-fit portion not further shown.

As indicated in FIGS. 1 and 3, the connector element 2 comprises two rows with signal contact pins 4 which are indicated by an s, wherein at both sides of each row with only signal contact pins 4 a row with only ground contact pins 5 indicated by a g is provided. The arrangement is such that a column with only ground contact pins 5 is provided on both sides of each column c with alternatingly signal contact pins 4 and ground contact pins 5. The rows with contact pins 4, 5 have a fixed intermediate spacing of 2 mm, while in row direction the ground contact pins 5 lie at a fixed intermediate spacing of 2 mm and the signal contact pins 4 lie at a fixed intermediate spacing of 4 mm.

The connector assembly 1 is further provided with a second connector element 8 with a second housing 9 of insulating material adapted to be inserted with an insertion side 10 in the first housing 3 of the connector element 2. The second connector element 8 is shown in perspective in FIG. 5 and includes two rows with female signal contacts 11 for contacting the signal contact pins 4 when the second housing 9 is received in the first housing 3. Each signal contact 11 is enclosed by an outer conductor 12 which seen in column direction has opposite contact springs 13. Each of the outer conductors 12 substantially entirely circumferentially encloses at least one of the signal contact pins 4. In inserted position these contact springs 13 contact the ground contact pins 5 of the first connector element 2 lying in the same column as the corresponding signal contact pin 4.

Figure 5:
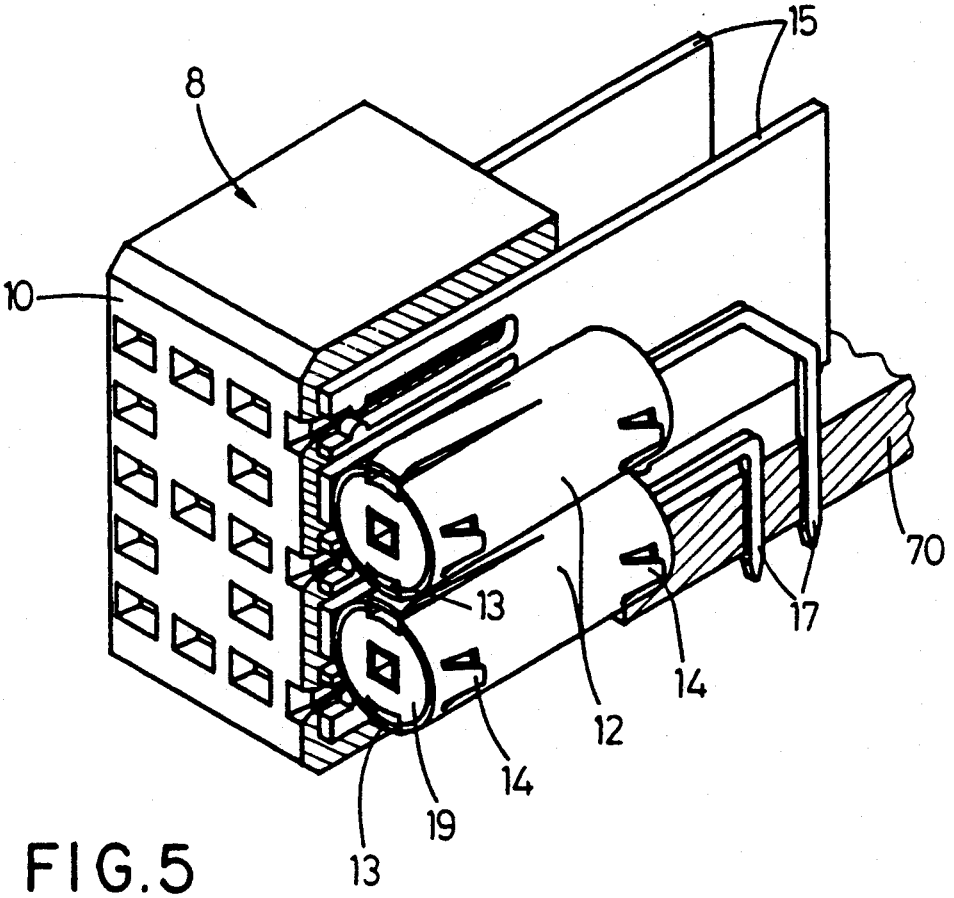
FIG. 5 is a partially shown perspective cut-away view of the second connector element of the connector assembly of FIG. 1.

Seen in row direction the outer conductors 12 have opposite contact tongues 14 adapted to contact ground contact plates 15 located on both sides of each outer conductor 12 in the second housing 9 The contact tongues 14 lying at the insertion side in FIG. 5 conduct the current to the inner side of the outer conductor 12 whereas the contact tongues 14 lying at the other end conduct the current from the inner side of the outer conductor to the ground contact plates 15.

Figure 4B:
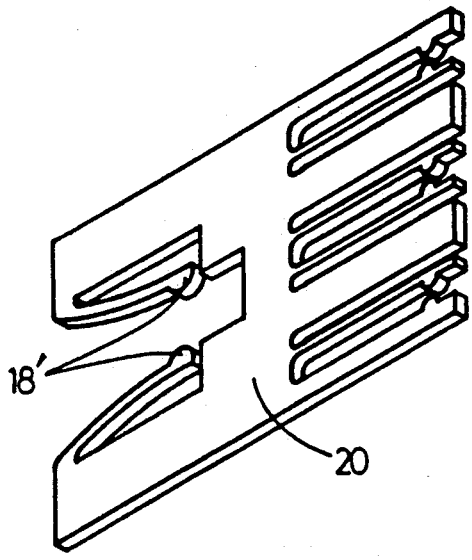
FIGS. 4*a* and 4*b* show perspective the ground contact plates of the second connector element of FIGS. 1 and 2, respectively.
Figure 4A:
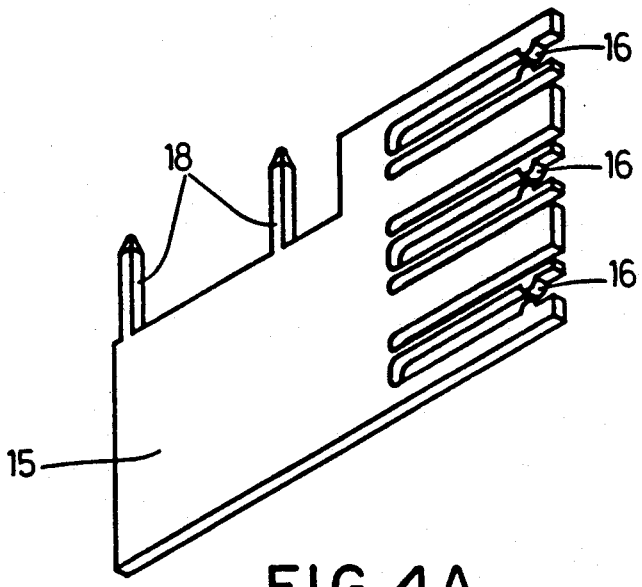

FIG. 4*a* shows one ground contact plate 15 in perspective. This ground contact plate 15 is provided with female contact elements 16 at the insertion side, which contact elements 16 cooperate with the columns with only ground contact pins 5 of the first connector element 2. In this manner a very good ground connection between both connector elements 2, 8 is obtained, wherein a favourable current distribution in the outer conductors 12 occurs.

Opposite of the insertion side the ground contact plates 15 extend beyond the connection elements 17 of the signal contacts 11. At these sides the ground contact plates 15 have connection elements 18 for connection to a printed circuit board 70 indicated with a dashed line in FIG. 1. The connection elements 17 and 18 maybe provided with a press-fit portion.

It is noted that the open space between each two succeeding ground contact plates 15 can be closed by providing a ground contact plate 15 with extensions which extend from this ground contact plate 15 to the adjacent ground contact plate 15. Thereby the signal contacts 11 will be fully enclosed by ground contact plates.

Due to the fact that the signal contacts 11 are surrounded by the outer conductors 12 and are further enclosed between the ground contact plates 15, the signal contacts 11 with the outer conductor 12/ground contact plates 15 form a transmission line with a geometry, of which the electrical parameters and thereby the performance as circuit element can be determined. The signal contacts 11 are mounted in the outer conductors 12 by means of dielectric inserts 19. These dielectric inserts 19 which can be manufactured by injection molding at low costs, have a predetermined dielectric constant. By providing larger or smaller recesses so that more or less air is present between the signal contacts 11 and the outer conductors 12, this dielectric constant can be determined and thereby among others the impedance of the transmission line formed by the signal contacts 11 and the outer conductors 12/ground contact plates 15. In this manner a connection can be realized with a constant impedance, wherein cross-over between signal contacts cannot occur because each signal conductor is surrounded by a ground conductor.

The connection elements 17, 18 of the signal contacts 11 and the ground contact plates 15 may also be made as contact springs adapted for surface mounting as appears from FIG. 2, showing a connector assembly, the connector element 2 of which fully corresponds with the connector element 2 of FIG. 1 and the connector element 8 of which is provided with ground contact plates 20 and signal contacts 11 adapted for surface mounting. The connection elements are indicated by 17' and 18'.

FIG. 4*b* shows in perspective a ground contact plate 20 used in the embodiment according to FIG. 2.

Figure 6:
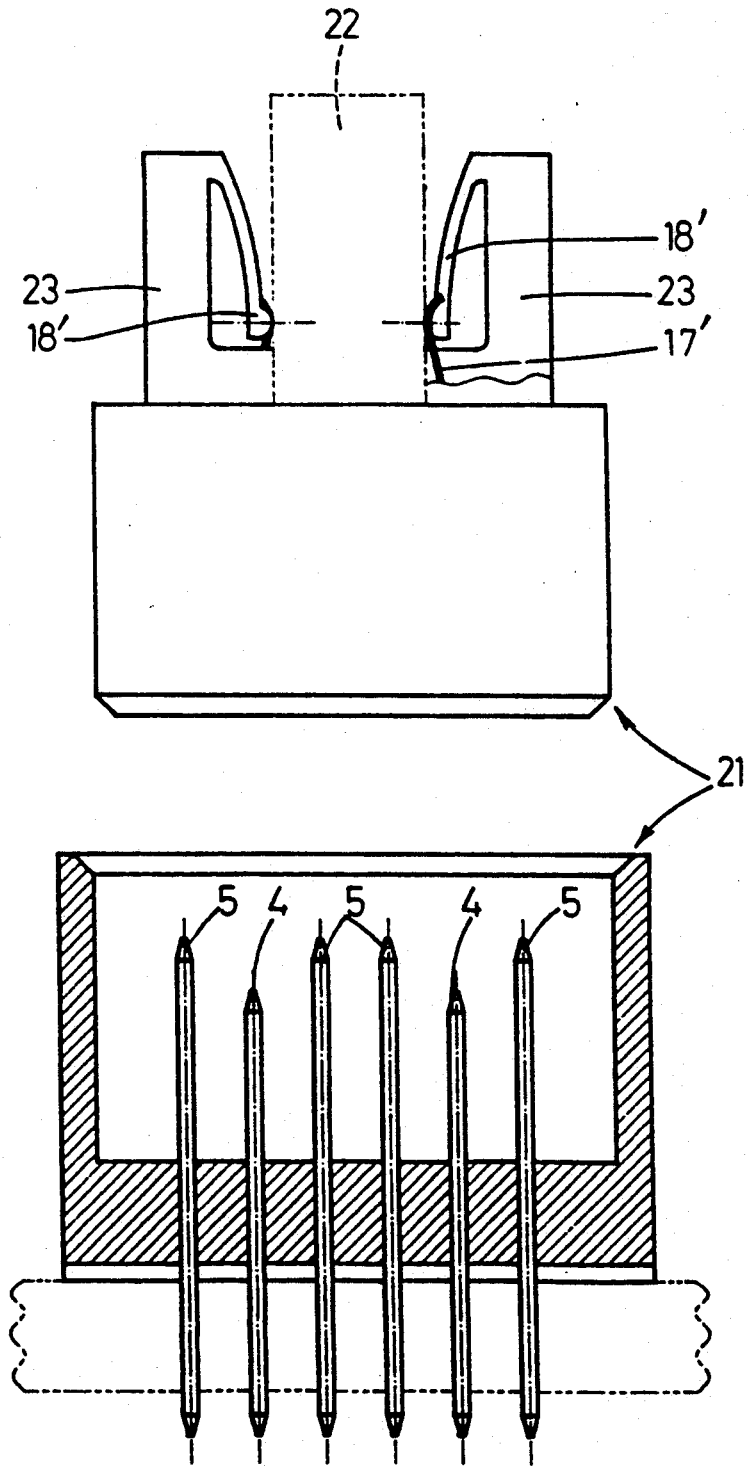
FIG. 6 is a section corresponding with FIG. 1 of an amended embodiment of the connector assembly according to the invention.

FIG. 6 shows a cross-section of a connector assembly 21 mainly made in the same manner as the connector assembly according to FIG. 2. In this case however two rows of ground contact pins 5 are mounted between the two rows of signal contact pins 4. Ground contact plates 23 each having a contact spring 18' are used, which contact plates 23 can only contact the ground contact pins 5 on both sides of the corresponding signal contact pins 4. Thereby separated ground connections for the two rows of signal contact pins 4 are obtained. Due to the increased width of the connector assembly 21 it is also possible to use a printed circuit board 22 with increased thickness.

Figure 7:
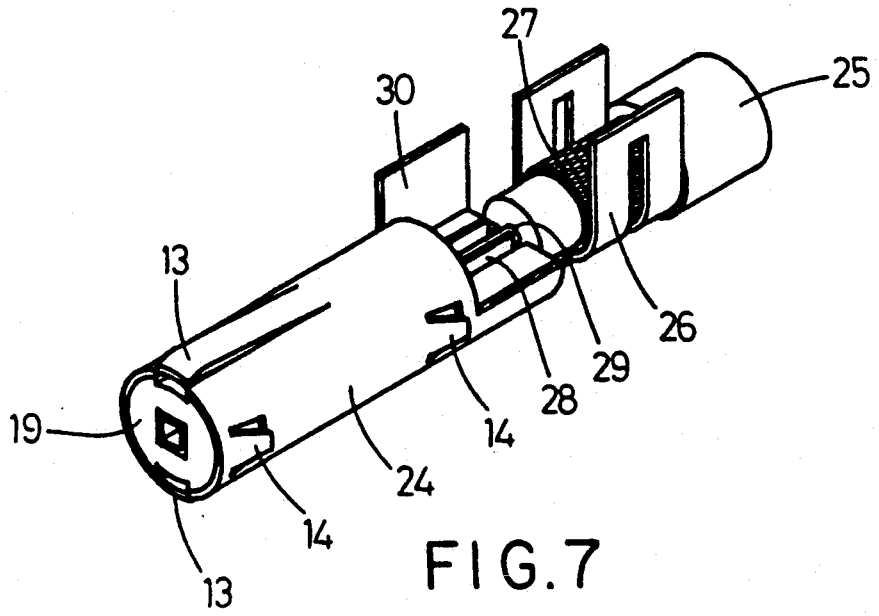
FIG. 7 is a perspective view of an amended embodiment of the outer conductor and corresponding signal contact as the same can be used in the second connector element.

FIG. 7 shows in perspective one outer conductor 24 which can be mounted in the second connector element 8 for connecting coaxial cables 25 to the printed circuit board 7. The outer conductor 24 comprises a connection element 26 to provide a simple connection with the outer conductor 27 of the coaxial cable 25. T this end the connection element 26 is first bent around the outer conductor 27. The signal contact not further shown and mounted in the outer conductor 24 by the dielectric insert 19, has a connection element 28 for connecting the inner conductor 29 of the coaxial cable 25. The connection between the outer conductor 27 and the inner conductor 29 can be obtained by soldering. After connecting the coaxial cable 25 the parts 30 which are bent open and one of which is not shown in FIG. 7 for the sake of clearness, are closed.

Figure 8:
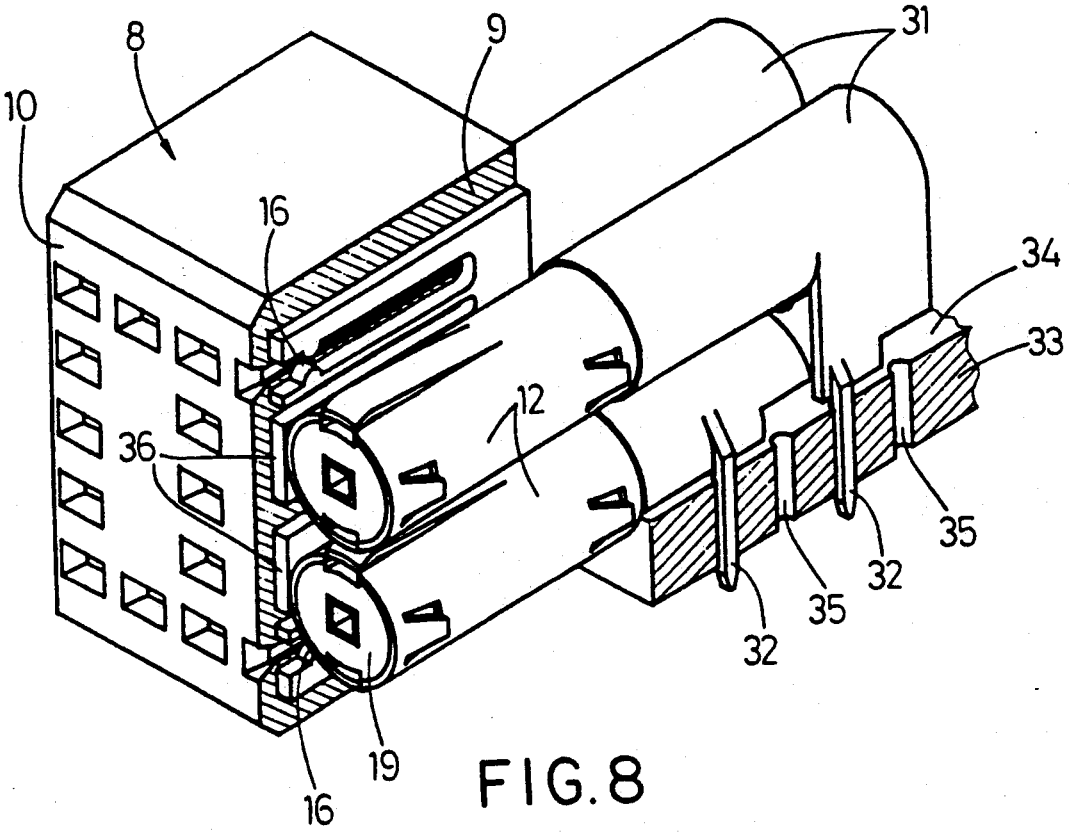
FIG. 8 is a partially shown perspective cut-away view of an amended embodiment of the second connector element of a connector assembly according to the invention.
Figure 8A:
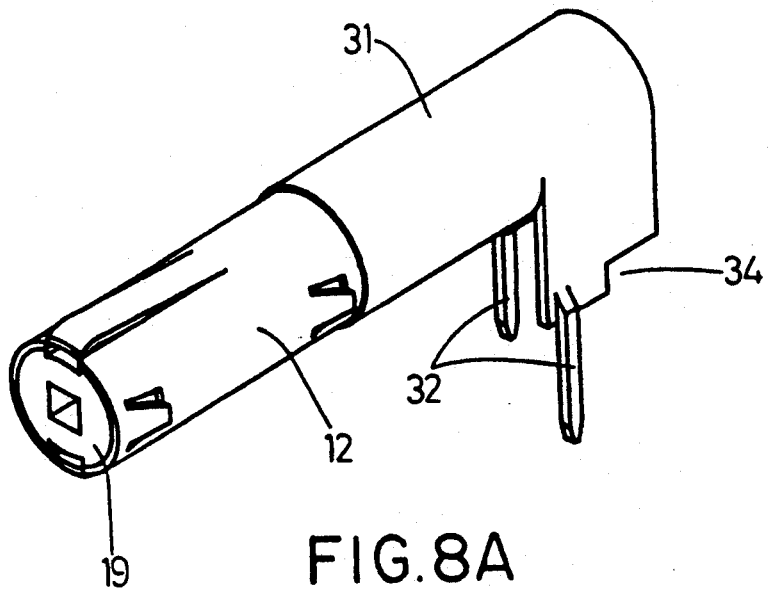
FIG. 8*a* is a perspective view of an outer conductor of the connector element of FIG. 8 with dielectric insert.

FIG. 8 shows a perspective view of an amended embodiment of the second connector element 8 with the housing 9, wherein the outer conductors 12 at the side opposite of the insertion side 10 are provided with an extension 31 having two ground contact pins 32 to be connected to a printed circuit board 33. In FIG. 8*a* one of the outer conductors with dielectric insert 19 and both ground contact pins 32 is shown in perspective. The ground contact pins 32 can be provided with a press-fit portion. As appears from FIG. 8*a*, the contact pins 32 are lying with respect to the longitudinal direction of the outer conductor 12 diagonally with respect to each other. Straight opposite of each contact pin 32 a recess 34 is provided, leaving free a hole 35 of the printed circuit board 33 which is intended to receive the ground contact pin 32 of an adjacent outer conductor 12.

Figure 9:
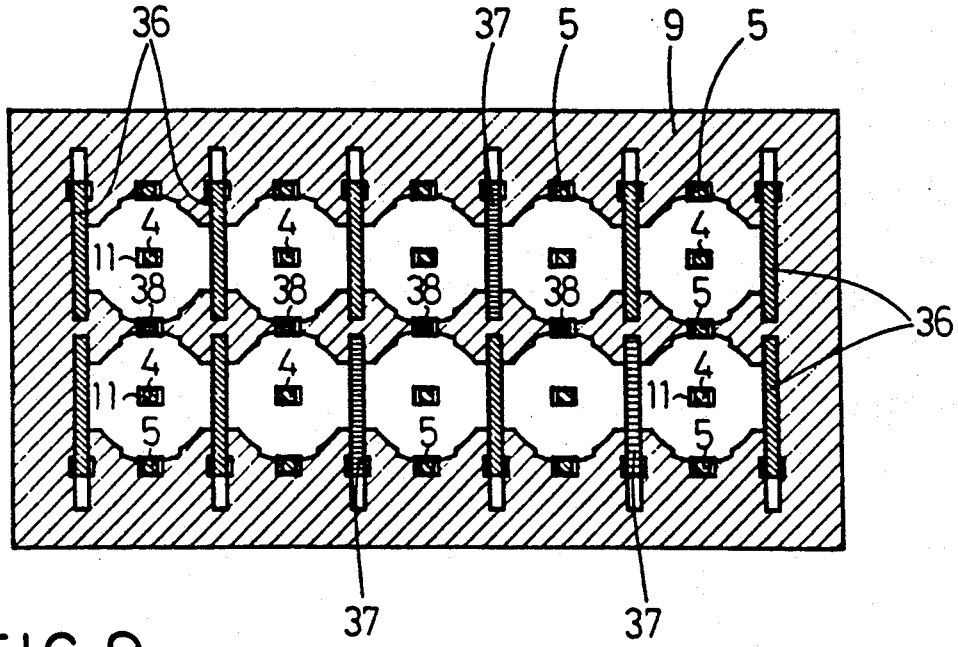
FIG. 9 is a schematic section of the connector element of FIG. 8 to explain the ground connection.

In the embodiment of the second connector element 8 according to FIG. 8 it is possible to give each group of one or more signal contacts a ground connection which is independent of the same of other groups of signal contacts. Thereby a programmable lay-out of ground connections is possible. By way of illustration FIG. 9 schematically shows a section of the housing 9 of the connector element 8, wherein for the sake of clearness the outer conductors 12 and the inserts 19 are not shown. In FIG. 9 the signal contacts 11 are indicated by an open rectangle, whereas the locations for the contact pins 4, 5 are indicated by shaded squares. In the second connector element 8 according to FIG. 8 ground contact plates 36 are used which are separated for the two rows of signal contact pins 4 and which are indicated in FIG. 9 by an oblique shading. These ground contact plates 36 have only one female contact element 16 which can only contact a corresponding ground contact pin 5 of the outermost rows of ground contact pins 5. In the embodiment shown insulating plates 37 (indicated by a horizontal shading) are provided at three locations in the housing 9 of the second connector element 8, while in the middle row of ground contact pins 5 only one ground contact pin 5 is mounted and four non-conductive insulating pins 38 (also horizontally shaded). Thereby the outer conductors 12 of different groups of signal contact pins 4 and corresponding female signal contacts 11 are insulated with respect to each other, so that the ground connection of these groups is separated and these groups cannot effect each other. By mounting at suitable locations the insulation pins 38 and insulating plates 37 instead of ground contact plates 36 and ground contact pins 5, each desired group of signal contacts with common ground connection can be realized. It is noted that instead of insulating pins 38 it is sufficient just to omit the ground contact pins 5 for separating the outer conductors 12 lying in one column.

The ground contact plates 36 can also be coated on one side with an insulating layer to obtain a separation between adjacent outer conductors 12. Thereby not only a separation is possible but the outer conductor 12 lying at the conductive side of the ground contact plate 36 maintains its ground connection through this ground contact plate.

Figure 10:
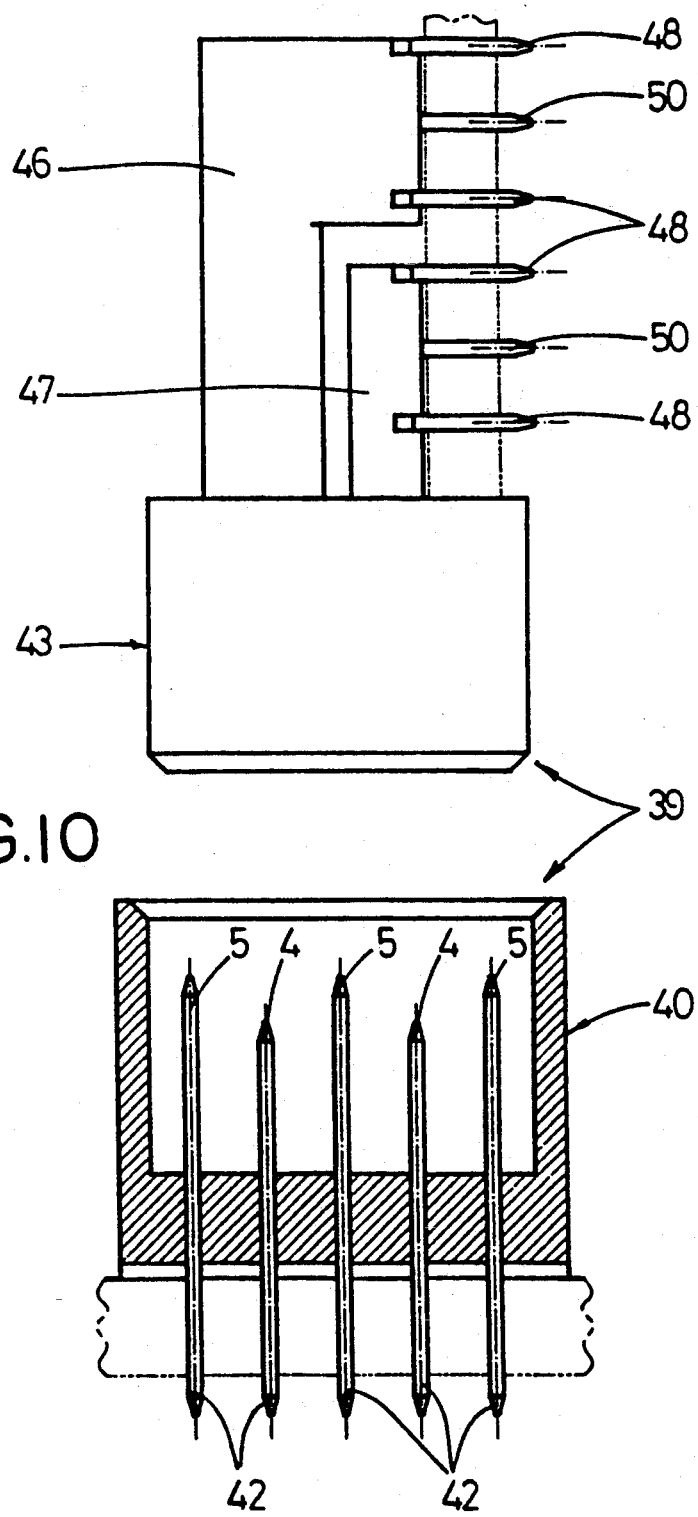
FIG. 10 is a section corresponding with FIG. 1 of an amended embodiment of the connector assembly according to the invention.
Figure 12:
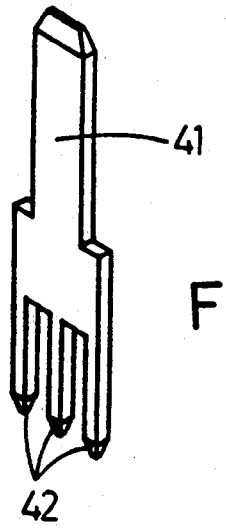
FIG. 12 is a perspective view of a ground contact of the first connector element of the connector assembly according to FIG. 10.

FIG. 10 shows a cross-section of a connector assembly 39, wherein the first connector element 40 mainly corresponds with the first connector element of FIG. 1. In this case however the contact pins 4, 5 are located in column direction at a mutual distance of 2.5 mm. The signal contact pins 4 lie at an intermediate spacing of 4.5 mm. Each three subsequent ground contact pins 5 are united into a ground contact lip 41 shown in FIG. 12, which can have three connection elements 42 with a mutual spacing of 1.5 mm.

As appears from FIG. 10, the connector assembly 39 comprises a second connector element 43 which in the same manner as the second connector element 8 is provided with two rows of female signal contacts. The second connector element 43 further comprises for each signal contact an outer conductor 44 and 45, respectively, having an extension 46 and 47, respectively. The outer conductors 44, 45 are perspectively shown in FIG. 11. The extensions 46, 47 have four connection elements 48 which may be provided with a press-fit portion. The outer conductors 44, 45 further have two contact springs 49 on both sides for contacting the ground contact lips 41 which are adjacent on both sides of the corresponding signal contact pin 4 of the first connector element 40. Thereby the ground connection is separated for each column of signal contacts. If two rows of ground contact pins 5 are provided between both rows of signal contact pins 4 as in the embodiment of FIG. 6, each signal contact pin 4 can have a separated ground connection.

Figure 11:
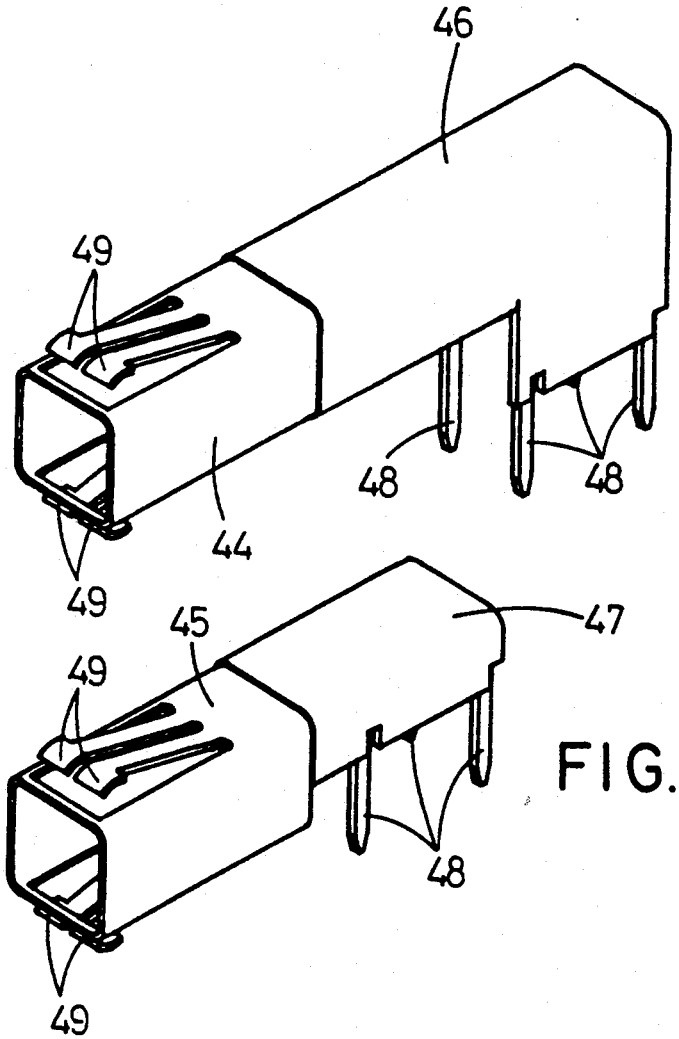
FIG. 11 is a perspective view of the outer conductors of the second connector element of the connector assembly according to FIG. 10.

Although not shown in FIG. 11, each female signal contact is mounted in the corresponding outer conductor 44, 45 also by means of a dielectric insert in the connector assembly 39. In FIG. 10 two connection elements 50 of the female signal contacts of the second connector element 43 are shown.

It is noted that in the embodiments of FIGS. 8 and 10 the signal contacts and the outer conductors of the second connector element are provided with connection elements for mounting in plated holes of a printed circuit board. Of course, also in these embodiments the connection elements can be made as contact springs for surface mounting.

Although in the above-described embodiments of the invention each female signal contact is enclosed by an outer conductor, it is also possible to mount two or more signal contacts within one outer conductor. Thereby twinax or triax connections with the same favourable properties can be obtained. The connector assembly according to the invention is therefor for example also suitable for use in systems equiped with ECL circuits.

Figure 13:
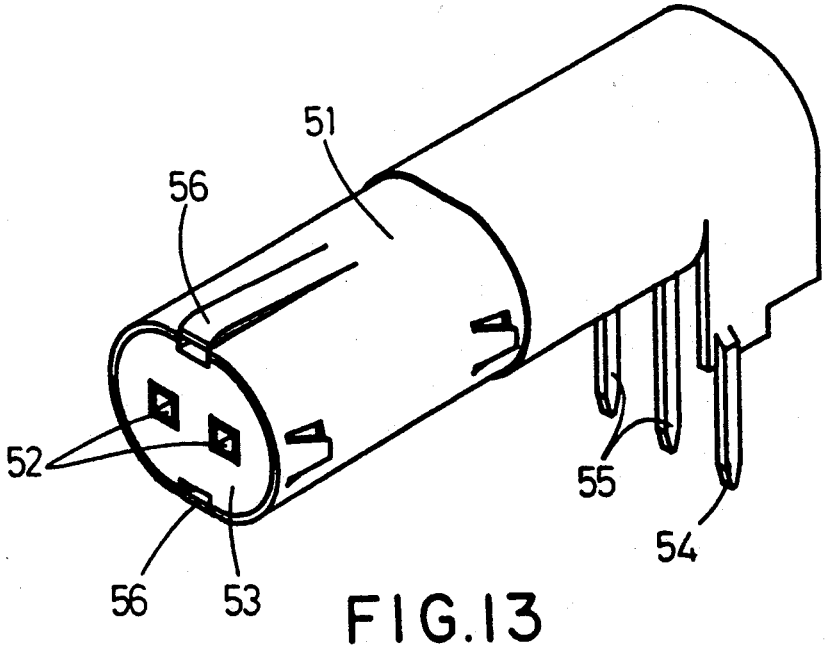
FIG. 13 shows in perspective an outer conductor of the second connector element with two female signal contacts.

FIG. 13 shows in perspective as an example an outer conductor 51 of a second connector element not shown, in which two female signal contacts 52 are mounted by means of an insert 53. The outer conductor 51 comprises ground connection elements 54, whereas the signal contacts 52 each have a connection element 55. Further the outer conductor 51 is provided with contact springs 56 for contacting ground contacts of the corresponding signal contact of the first connector element not shown. It will be clear that both connector elements can be made in the above-described manner for the remaining part.

The described connector assemblies already give a substantial improvement as to the high frequency performance. A further improvement can even be obtained if the signal contacts of the first connector element are mounted in an outer conductor in the same manner as the signal contacts of the second connector element.

Figure 15:
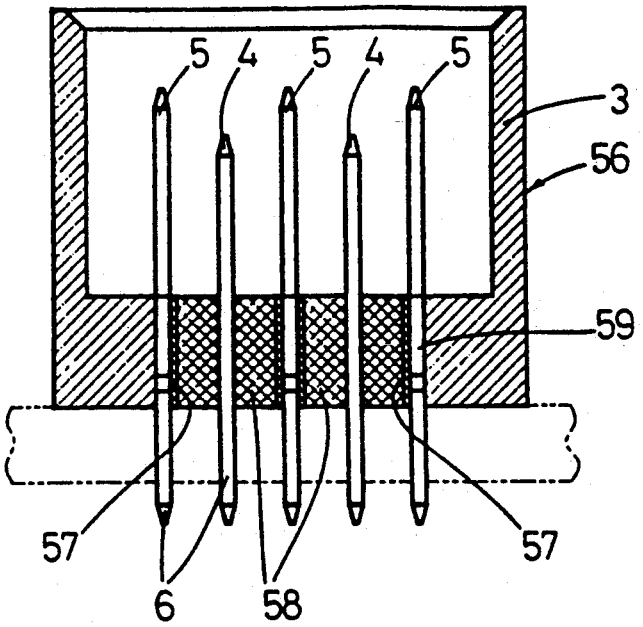
FIG. 15 is a section according to the line XV—XV of FIG. 14.
Figure 14:
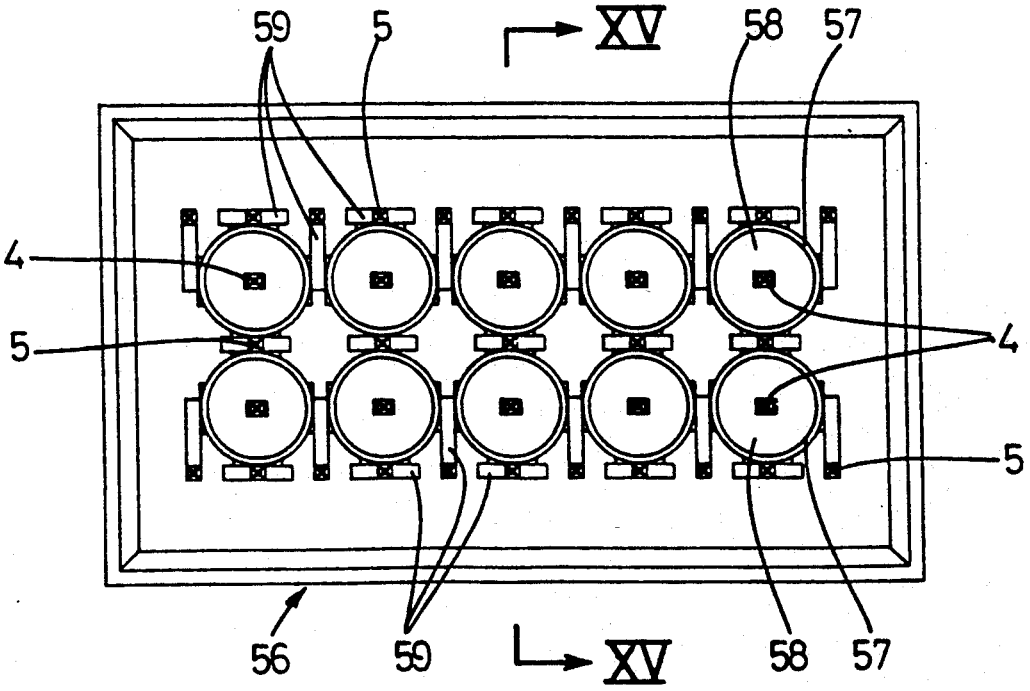
FIG. 14 is a top view of an alternative embodiment of the first connector element according to the invention.

FIGS. 14 and 15 show a top view and a section, respectively, of a first connector element 56, wherein each signal contact 4 is enclosed by an outer conductor 57 along the portion of the signal contact extending in the insulating material of the first housing 3. The signal contacts 4 are in this case mounted in the outer conductor 57 be means of an insert 58. It is noted that in this case also two or more signal contacts 4 can be enclosed by a common outer conductor 57.

Figure 16:
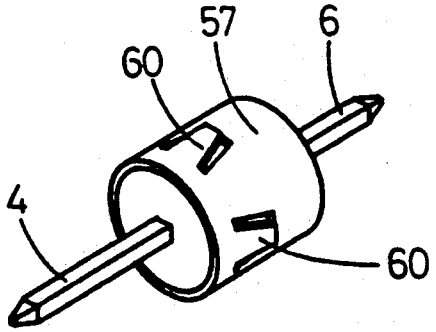
FIG. 16 a perspective view of an outer conductor with signal contact of the first connector element of FIG. 14.

The ground contacts 5 of the connector element 56 each comprise a plate-like portion 59 contacting the outer conductor 57 of adjacent signal contacts 4. At the location of the contact points the outer conductors 57 are provided with a contact tongue 60 as shown in FIG. 16.

Figure 17:
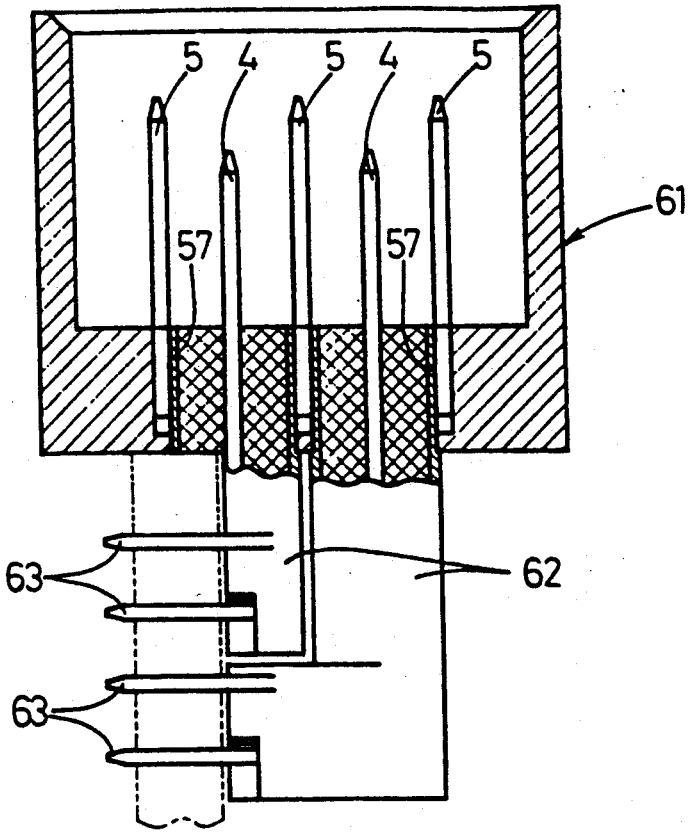
FIG. 17 is a section corresponding with FIG. 15 of a first connector element with amended connection to a printed circuit board.

In FIG. 17 a section as in FIG. 15 of a first connector element 61 is shown, which connector element 61 is adapted for a perpendicular connection to a printed circuit board indicated by a dashed line.

In this case the outer conductors 57 comprise an extension 62 which in the same manner as the extensions 31 of the outer conductors 12 is provided with ground connection elements 63. In this case the ground contacts 5 are made without connection elements 6. By way of illustration the outer conductors 57 with extensions 62 are perspectively shown in FIG. 18. As appears from FIG. 18, the connection elements 63 are provided in the same manner as the connection elements 32 of the extension 31 of the outer conductors 12. Also in this case recesses 34 are made for the connection elements of adjacent outer conductors. In FIG. 18 the signal contact pins 4 with their connection elements 6 can also be seen.

It is noted that in the described embodiments of the connector assembly according to the invention the first connector element comprises rows of only signal contacts. It is however also possible to mount a ground contact between subsequent signal contacts. In that case the ground contact plates of the corresponding second connector elements can be omitted so that the ground contacts lying in a row of signal contacts can directly contact the outer conductors through suitable contact springs or the like.

In the first connector element 56 according to FIG. 14 it is also possible to mount ground contacts between subsequent signal contacts.

Further it is noted that it is possible to use for example U-shaped outer conductors, wherein the subsequent outer conductors join each other so that more or less closed outer conductors are obtained.

The connector assembly according to the invention can also be provided with signal contacts mounted in the usual manner which of course are only suitable for relatively low frequency signals.

From the above description it will be clear that the invention provides a connector assembly wherein the signal contacts with corresponding outer conductors can be considered as a transmission line with such a geometry that the electrical parameters of the connector assembly can be determined. Thereby it is possible to adapt the impedance of the signal contacts to the output impedance of the signal source and input impedance of the receiver.

The connector assembly according to the described embodiments of the invention provides a connection with a predetermined impedance between printed circuit boards or between a printed circuit board and a multi-core cable. The manufacturing costs of this connector assembly are relatively low because all signal and ground contacts and outer conductors can be manufactured by stamping and forming. Further both press-fit and surface mounting connections to printed circuit boards are possible. The connection between male and female contacts can be compared with the same of the known connector assemblies so that the favourable mechanical properties thereof, like coupling and decoupling forces and in particular the tolerances with respect to the mutual positions of the contacts, are maintained when used in rack and panel configurations.

The invention is not restricted to the above-described embodiments which can be varied in a number of ways within the scope of the following claims.

What is claimed is:

1. Connector assembly for a printed circuit board, comprising:

a first connector element with a first holding of insulating material and regularly arranged male signal and ground contacts connectable to a printed circuit board, and a second connector element with a second housing of insulating material, said second connector element having a mating side which can be inserted into the first housing, and with regularly arranged female signal and ground contacts with a connection element, which female contacts will contact the corresponding male contact when the second housing is received in the first housing, characterized in that said second connector element is provided with a plurality of outer conductors, selected ones of said outer conductors substantially entirely circumferentially enclosing at least one of said signal contacts, and each of said outer conductors having contact spring sections at opposite sides of said outer conductor adapted to contact the ground contacts adjacent to the corresponding signal contact of the first connector element.

2. Connector assembly according to claim 1, wherein each outer conductor of the second connector element is provided with a dielectric insert, the corresponding signal contact being mounted in said insert.

3. Connector assembly according to claim 1, wherein the male and female contacts are arranged in parallel rows and columns, and wherein the first connector element comprises at least one row with signal contacts, wherein a row with only ground contacts is provided at both sides of each row with signal contacts.

4. Connector assembly according to claim 1, wherein the first connector element is provided with a column with only ground contacts at both sides of each column with one or more signal contacts and ground contacts.

5. Connector assembly according to claim 1 characterized in that seen in the direction of the respective row of signal contacts each outer conductor is provided with opposite contact tongues for contacting ground contact plates which can be mounted at both sides of each outer conductor in the second housing, said ground contact plates being provided with female contact elements at the mating side for contacting the ground contacts of the first connector element.

6. Connector assembly according to claim 5, wherein a ground contact plate is provided at both sides of each outer conductor, said ground contact plate having ground connection elements at a side opposite of the mating side.

7. Connector assembly according to claim 6, wherein each ground contact plate extends at the side opposite of the mating side beyond the connection elements of the signal contacts.

8. Connector assembly according to claim 5, wherein the first connector element comprises two rows with ground contacts between two rows with signal contacts, wherein each ground contact plate of the second connector element can only contact the ground contacts of the rows with ground contacts at both sides of the corresponding row with signal contacts.

9. Connector assembly according to claim 5, wherein each outer conductor of the second connector element has an extension opposite of the mating side, said extension having ground connection elements.

10. Connector assembly according to claim 9, wherein a ground contact plate can be provided adjacent to each of the outer conductors of each row with signal contacts of the second connector element, which ground contact plate is adapted to contact a ground contact of rows with ground contacts which are not adjacent to other rows of signal contacts, wherein a ground contact can be provided or not, as desired, in each column with two or more signal contacts of the first connector element between two signal contacts.

11. Connector assembly according to claim 10, wherein in the absence of a ground contact plate an insulation plate or a ground contact plate with an insulation layer at one side is provided adjacent an outer conductor of the second connector element and in that at the absence of a ground contact between two signal contacts in the same column of the first connector element an insulating pin is provided.

12. Connector assembly according to claim 9, wherein each outer conductor of the second connector element has two connection pins for connection to a printed circuit board, which connection pins are located diagonally with respect to the longitudinal direction of the outer conductor, wherein opposite of each connection pin a recess is provided in the outer conductor for receiving the connection pin of an adjacent outer conductor.

13. Connector assembly according to claim 12, wherein the ground contacts of the first connector element are united in groups in each row into ground contact lips, wherein each outer conductor of the second connector element is adapted to contact only those ground contact lips which are adjacent the corresponding signal contact on both sides thereof.

14. Connector assembly according to claim 13, one or more outer conductors and corresponding signal contacts of the second connector element are provided with connection elements for connecting a coaxial cable.

15. Connector assembly according to claim 14, wherein the first connector element is provided with a plurality of outer conductors, each of said outer conductors mainly enclosing at least one signal contact in a circumferential direction along at least the part of the/each signal contact extending in the insulating material of the first housing and each of said outer conductors being adapted to contact the adjacent ground contacts of the/each corresponding signal contact of the first connector element.

16. Connector assembly according to claim 15, wherein each outer conductor of the first connector element is provided with a dielectric insert, the/each corresponding signal contact being mounted in said insert.

17. Connector assembly according to claim 16, wherein each outer conductor is provided with contact tongues for contacting the ground contacts.

18. Connector assembly according to claim 17, wherein the ground contacts of the first connector element each comprise a plate-like part for contacting a contact tongue of the outer conductor of the/each adjacent signal contact.

19. Connector assembly according to claim 18, wherein each outer conductor of the first connector element is provided with an extension at its side opposite of the second connector element, said extension being provided with ground connection elements for connecting the ground contacts to a printed circuit board, said ground connection elements extending perpendicular to the longitudinal direction of the outer conduct.

20. A connector assembly comprising:

a first connector element having a first housing with first signal and ground contacts; and a second connector element having a second housing with second signal and ground contacts and a plurality of outer conductors, the second connector element being removably connected to the first connector element with the first signal contacts contacting the second signal contacts and at least some of the first ground contacts contacting the second ground contacts, each of the outer conductors substantially entirely circumferentially enclosing at least one of the second contacts and having contact spring sections at opposite sides of the outer conductor contacting the first ground contacts located at the opposite sides of the outer conductor.

* * * * *